US012667129B1

(12) United States Patent
Campbell et al.

(10) Patent No.: US 12,667,129 B1
(45) Date of Patent: Jun. 30, 2026

(54) NICOTINE POUCHES FOR SMOKING CESSATION

(71) Applicant: NAQA Holding Ltd, Abu Dhabi (AE)

(72) Inventors: James Preston Campbell, Goodlettsville, TN (US); Sameena Kathryn Masood-Campbell, Goodlettsville, TN (US); Keaton James Campbell, Smyrna, TN (US)

(73) Assignee: NAQA Holding Ltd, Abu Dhabi (AE)

( * ) Notice: Subject to any disclaimer, the term of this patent is extended or adjusted under 35 U.S.C. 154(b) by 0 days.

(21) Appl. No.: 19/386,477

(22) Filed: Nov. 12, 2025

(51) Int. Cl.

| | |
|---|---|
| ***A24B 15/24*** | (2006.01) |
| ***A24B 15/30*** | (2006.01) |
| ***A24B 15/32*** | (2006.01) |
| ***A24F 23/02*** | (2006.01) |

(52) U.S. Cl.
CPC ..... *A24B 15/243* (2013.01); *A24B 15/303* (2013.01); *A24B 15/32* (2013.01); *A24F 23/02* (2013.01)

(58) Field of Classification Search
CPC ..... A24B 13/00; A24B 15/243; A24D 1/14
See application file for complete search history.

(56) References Cited

U.S. PATENT DOCUMENTS

| | | | | |
|---|---|---|---|---|
| 9,161,908 | B2 | 10/2015 | Nilsson | |
| 9,402,810 | B2 | 8/2016 | Nilsson | |
| 11,096,412 | B2 | 8/2021 | Stahl | |
| 11,432,581 | B2 | 9/2022 | Mishra | |
| 11,540,557 | B2 | 1/2023 | Stahl | |
| 2016/0157515 | A1 | 6/2016 | Chapman | |
| 2020/0383372 | A1* | 12/2020 | Stahl | A24B 15/16 |

FOREIGN PATENT DOCUMENTS

| | | |
|---|---|---|
| WO | 2010031552 | 3/2010 |

OTHER PUBLICATIONS

Varimixer, varimixer.com/wp-content/uploads/2023/03/Data-sheets_GB_AR60.pdf. Accessed Jan. 26, 2026. (Year: 2026).*

* cited by examiner

*Primary Examiner* — Michael H. Wilson
*Assistant Examiner* — Stephanie Lynn Moore
(74) *Attorney, Agent, or Firm* — JMB Davis Ben-David

(57) ABSTRACT

Provided herein, according to an embodiment, is a nicotine-containing moist granulate composition comprising: nicotine or a pharmaceutically acceptable salt thereof; mannitol, and cellulose; the composition having a total moisture content of between 35-45%. The granulate shows favorable organoleptic qualities such as taste and mouthfeel and is free flowing to enable packaging in pouches. Optionally, the composition further comprises an oral health enhancing agent.

19 Claims, 1 Drawing Sheet

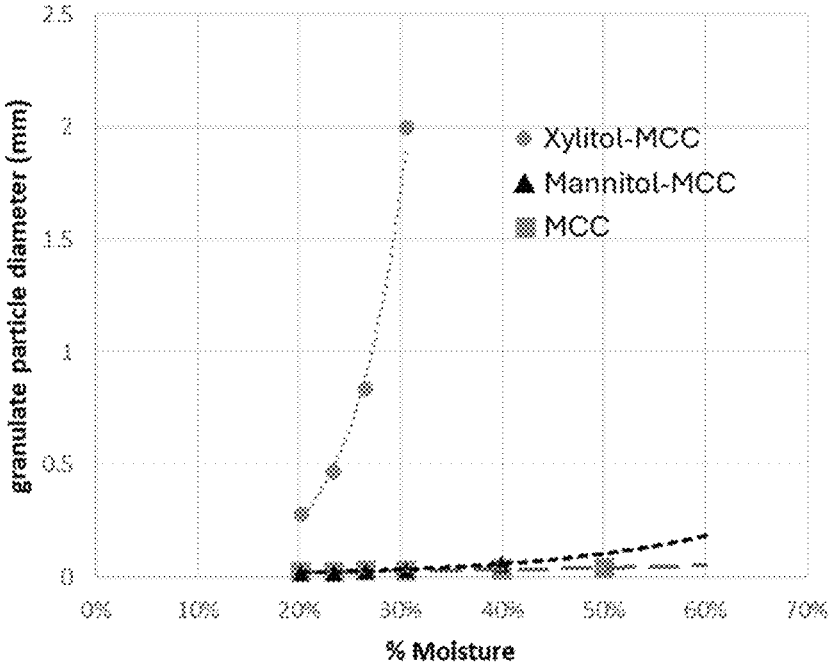
2.5
2
1.5
1
0.5
0
granulate particle diameter (mm)
0%
10%
20%
30%
40%
50%
60%
70%
% Moisture
Xylitol-MCC
Mannitol-MCC
MCC

NICOTINE POUCHES FOR SMOKING CESSATION

FIELD

Provided herein are nicotine containing pouches and methods of their manufacture.

BACKGROUND

Extensive evidence supports nicotine replacement therapies as effective aids in smoking cessation. Oral forms of nicotine replacement therapies such as gum, lozenges, and pouches, can be useful for managing nicotine cravings in situations in which smoking is not possible. Nicotine pouches provide rapid nicotine absorption into a user's bloodstream through the oral (buccal) mucosa, aiding in addressing nicotine withdrawal symptoms and facilitating gradual reduction in nicotine dependence.

Nicotine pouches can be advantageous as they can be tobacco-free and formulated with pharmaceutical-grade nicotine or nicotine slats, along with fillers and other excipients. They can be used discreetly to administer nicotine, obviating the need for combustion or chewing of tobacco, while administering lower levels of carcinogens than alternative methods.

SUMMARY

Provided herein, according to an embodiment, is a nicotine-containing moist granulate composition comprising: nicotine or a pharmaceutically acceptable salt thereof; mannitol, and cellulose; the composition having a total moisture content of between 35-45%. Optionally, the composition further comprises an oral health enhancing agent.

BRIEF DESCRIPTION OF THE FIGURES

FIG. 1 depicts a graph showing mean particle diameter of nicotine-containing granulate at various moisture levels prepared according to an embodiment comprising microcrystalline cellulose and mannitol (Mannitol-MCC, depicted by black triangles) as compared to nicotine containing granulate comprising microcrystalline cellulose (over 70%, MCC, depicted by grey squares) and to nicotine containing granulate comprising microcrystalline cellulose and xylitol (Xylitol-MCC, depicted by grey circles).

DETAILED DESCRIPTION

Unless otherwise noted, technical terms are used according to conventional usage. Definitions of common terms in pharmaceutical sciences can be found in Troy et al. Remington: The Science and Practice of Pharmacy. Published by Lippincott Williams & Wilkins, 2006. In case of conflict, the present specification, including explanations of terms, will control. In addition, all the materials, methods, and examples are illustrative and not intended to be limiting.

Unless otherwise explained, all technical and scientific terms used herein have the same meaning as commonly understood by one of ordinary skill in the art to which this disclosure belongs. The singular terms "a," "an," and "the" include plural referents unless context clearly indicates otherwise. Similarly, the word "or" is intended to include "and" unless the context clearly indicates otherwise. It is further to be understood that all base sizes or amino acid sizes, and all molecular weight or molecular mass values, given for nucleic acids or polypeptides are approximate, and are provided for description. Although methods and materials similar or equivalent to those described herein can be used in the practice or testing of this disclosure, suitable methods and materials are described below. The term "comprises" means "includes." The abbreviation, "e.g." is derived from the Latin exempli gratia and is used herein to indicate a non-limiting example. Thus, the abbreviation "e.g." is synonymous with the term "for example."

Terms:

Combination: A treatment modality combining two or more treatments (therapies or agents). Combination therapy may involve administration of the two or more treatments at the same time, sequentially, or with a gap of time between the administrations. In combination therapy, although not always administered simultaneously, the biological effects of both of the drugs or treatments occur on the subject at relatively the same time. Combination therapy may involve two (or more) drugs or treatments in one dosage form or multiple drugs or treatments in separate dosage forms. Combination therapy may involve combining both agents in a single dosage form before administration, or administering the agents in separate dosage forms.

Flavoring: A flavoring is an excipient acceptable for human consumption that imparts or modifies the organoleptic character (taste and/or aroma) of a composition to improve palatability and patient compliance, particularly by reducing or masking bitterness and other aversive notes of active ingredients through gustatory, olfactory, and chemesthetic mechanisms. Suitable flavorings include natural, nature-identical, and synthetic agents used alone or in combinations, such as mint-derived materials (e.g., menthol; peppermint oil containing menthol, menthone, and menthyl acetate) that provide cooling and trigeminal effects which can diminish perceived bitterness and irritation in oral products. Additional suitable flavorings and flavor systems include essential oils (e.g., peppermint, spearmint, lemon, orange, eucalyptol-containing oils), fruit, citrus, berry, chocolate/cocoa, vanilla/vanillin, and spice profiles (e.g., clove, cinnamon), optionally combined with sweeteners or enhancers (e.g., sucralose, aspartame, maltol/ethyl maltol) to synergistically suppress bitterness and improve hedonic response. Flavorings may be delivered neat, encapsulated, or as commercial blends, and may be paired with taste-masking approaches (e.g., sweeteners and peppermint oil) demonstrated to attenuate bitter APIs in fast-dissolving films and related oral formats. In certain embodiments, menthol and peppermint oil are preferred flavorings for nicotine or other bitter actives due to their established use in masking unpleasant taste and providing consumer-acceptable sensory profiles in oral care and confectionery analogs.

Pharmaceutically Acceptable Salt: The term "pharmaceutically acceptable salt" of a given compound refers to salts that retain the biological effectiveness and properties of the given compound, and which are not biologically or otherwise undesirable. Pharmaceutically acceptable acid addition salts may be prepared from inorganic and organic acids. Salts derived from inorganic acids include hydrochloric acid, hydrobromic acid, sulfuric acid, nitric acid, phosphoric acid, and the like. Salts derived from organic acids include acetic acid, propionic acid, glycolic acid, pyruvic acid, oxalic acid, malic acid, malonic acid, succinic acid, maleic acid, fumaric acid, tartaric acid, citric acid, methanesulfonic acid, ethanesulfonic acid, p-toluene-sulfonic acid, and the like. Pharmaceutically acceptable salts of nicotine include nicotine monotartrate and nicotine citrate.

Therapeutically effective amount: an amount of a compound sufficient to show benefit to the individual. This amount prevents, alleviates, abates, or otherwise reduces the severity of a symptom associated with addiction in a patient.

Total Moisture: moisture in a product as measured using a "loss on drying" (LOD) method at 80° C. for 30 minutes in oven with air circulation, while measuring mass before, during and after.

Overview of Several Embodiments

Nicotine pouches provided herein are a convenient, easy to use agent for assistance in smoking cessation. They provide ease of use at times when smoking is not possible, a pleasant mouthfeel, flavor release, and rapid administration of nicotine to the user.

A number of health issues have been associated with tobacco use, among them, oral health issues. Oral health problems such as dental caries, periodontal disease, and oral mucosal lesions are prevalent in smokers and smokeless tobacco users, and sometimes worsen during smoking cessation due to increased food consumption and changes in oral hygiene habits which may result from smoking cessation. Poor oral health can negatively impact smoking cessation rates; for example, oral pain or discomfort may lead individuals to substitute cigarettes for oral nicotine products, or to relapse to smoking tobacco for relief from withdrawal-related oral symptoms. Conversely, improving oral health may provide psychological and physiological reinforcement for people attempted to reduce tobacco intake, reduce the risk of tobacco-induced lesions like leukoplakia, and promote positive feedback, such as reduced plaque, improved sense of taste, or less halitosis, thereby increasing user motivation and satisfaction with their cessation attempts. Interventions targeting gum health, tooth remineralization, and oral comfort can significantly boost adherence to cessation aids and the likelihood of long-term smoking and smokeless tobacco abstinence.

As such, according to some embodiments, provided are nicotine pouches which include nicotine or a pharmaceutically acceptable salt thereof, and an oral health enhancing agent, wherein the oral health enhancing agent is selected and dosed to provide at least one of the following effects during or following use: enhancement of tooth and/or bone remineralization, stimulation of osteoblast activity, promotion of tooth and/or bone regeneration, inhibition of tooth decay, and/or reduction of oral sensitivity, while delivering nicotine over a targeted residence period of about 5-30 minutes in the oral cavity, optionally about 10-20 minutes in certain embodiments, to balance onset and total delivered dose.

Nicotine pouches described herein are stable products comprising a flowable granulate that maintains physical and chemical integrity during manufacture and storage yet initiates dissolution immediately upon wetting with saliva, wherein: (a) "stable" refers to retention of at least 95% labeled nicotine content, no increase in total impurities above ICH Q3B thresholds, water activity maintained below 0.6 (or as specified for the formulation), and no loss of granulate flowability beyond pre-defined Hausner ratio/angle-of-repose limits over the labeled shelf life; (b) stability is demonstrated under real-time conditions of about 25±2° C. and 60±5% RH, and accelerated conditions of about 40±2° C. and 75±5% RH for up to 6 months, with photostability per ICH as applicable; (c) manufacturing exposure to ambient air is controlled such that in-process hold times do not exceed a validated window (e.g., up to 8 hours cumulatively at 20-25° C. and ≤60% RH) without exceeding moisture and impurity specifications; (d) upon use, the pouch contents partially dissolve such that the majority of soluble components, including nicotine, sweeteners, acids/bases, and flavorants, dissolve, while insoluble excipients (e.g., microcrystalline cellulose, calcium carbonate, hydroxyapatite, silica, and other bulking or flow agents) remain largely undissolved and contained within the pouch substrate; and (e) dissolution begins immediately on contact with saliva, with nicotine release kinetics tuned by adjusting formulation pH (e.g., via carbonate/bicarbonate, citrate, phosphate, or similar buffer systems) and by selecting excipient combinations (e.g., disintegrants, binders, and wetting agents) to achieve an onset within about 1-3 minutes and a sustained delivery over about 5-30 minutes, optionally 10-20 minutes, while maintaining user comfort and consistent sensory performance. Granulation is the process of forming granules from a powdery substance and is typically used in the pharmaceutical field to improve flow properties and uniformity in dosing of a pharmaceutical product. It may also be used to enhance compressibility when a granulate is later compressed into tablets. Whereas conventional pharmaceutical granulation aims for dry, free-flowing powders, the granulates described herein are high in moisture, preferably having a total moisture of above 30%, to allow for use in oral pouch applications. A moist granulate in a nicotine pouch is advantageous in that it provides a pleasant mouthfeel and taste when administered to a user, and begins acting immediately upon administration, in contrast to a dry granulate, which requires time to be wetted by saliva and only after wetting can then administer nicotine and flavoring agents to the user.

Described herein are novel, nicotine-containing granulates having high moisture levels of above 30% total moisture, which are suitable for further processing into nicotine pouches.

When developing high moisture nicotine-containing granulates, xylitol was used. Xylitol is an anticariogenic polyol and is highly water-soluble (62 g/100 mL at 25° C.). However, at high moisture content (≥20%), xylitol-based granulates undergo hygroscopic clumping and "hypergranulation". This behavior leads to sticky, viscous masses that adhere to granulator blades and feeding hoppers, causing process downtime, erratic dosing, and ultimately an unworkable product in automated pouch-filling equipment.

Additional attempts were made to develop high moisture nicotine-containing granulates using high (40-80%) amounts of cellulose, in particular microcrystalline cellulose. However, these attempts too were unsuccessful.

Mannitol, in contrast, is a polyol which is less soluble than xylitol, being sparingly soluble in water (about 18 g/100 mL at 25° C.). The inventors surprisingly found that using mannitol in nicotine-containing granulates, allowed for a high-moisture (up to 40%) granulate to remain free-flowing, and non-clumping under otherwise similar mixing and packing conditions, which were unacceptable when xylitol-based nicotine granulates were used. This enables stable, large-scale manufacturing of moist nicotine pouch granulates using mannitol as a major excipient. Despite mannitol being only moderately water-soluble, the moist mannitol-based granulate dissolves rapidly in the mouth, releasing sweetness and the nicotine payload much more efficiently than would be anticipated by its calculated solubility in pure water.

Without being bound by theory, it is suggested that the mannitol, along with other excipients such as microcrystalline cellulose, forms a porous, non-hygroscopic matrix at high moisture. The mannitol-based granulate does not undergo glass transitions or deliquescence that was evident with xylitol, that resulted in sticky agglomerate in the attempts to make xylitol-based granulate.

Described herein, according to an embodiment, is a nicotine-containing moist granulate composition comprising: nicotine, or a pharmaceutically acceptable salt thereof, in an amount of nicotine free base equivalent between 0.1-4% by weight of the non-aqueous portion of the composition; mannitol in an amount of between 20-50% by weight of the non-aqueous portion of the composition; and total moisture of between 35-45%. Optionally, the composition further comprises cellulose in an amount of between 28-38% by weight of the non-aqueous portion of the composition. Optionally, the nicotine is present in an amount of nicotine free base equivalent between 0.6-4% by weight of the non-aqueous portion of the composition. Optionally, mannitol is present in an mount of between 38-45% by weight of the non-aqueous portion of the composition. Optionally, the composition further comprises at least one oral health enhancing agent. Optionally, the oral health enhancing agent is present in an amount of between 5-10% by weight of the non-aqueous portion of the composition. Optionally, the oral health enhancing agent is selected from the group consisting of: hydroxyapatite, tricalcium phosphite, dicalcium phosphate dihydrate, octacalcium phosphate, amorphous calcium phosphate, calcium carbonate, calcium sulfate dihydrate, fluorapatite, monocalcium phosphate, functionalized tricalcium phosphate, and casein phosphopeptide-amorphous calcium phosphate. Optionally, the composition further comprises at least one buffer. Optionally, the buffer is selected from the group consisting of $NHCO_3$ and $Na_2HCO_3$. Optionally, the composition further comprises magnesium stearate. Optionally, the composition further comprises xanthan gum, guar gum, alibizia gum, ficus vasta gum, sesbania gum, locust bean (carob) gum, or gum Arabic. Optionally, the composition further comprises hydroxypropylmethyl cellulose. Optionally, the composition further comprises at least one flavoring. Optionally, the composition has a mean particle diameter Optionally, the cellulose is microcrystalline cellulose. Optionally, the nicotine is in the form of a pharmaceutical acceptable salt selected from the group consisting of: nicotine monotartrate and nicotine citrate. Optionally, the nicotine is in the form of nicotine monotartrate.

Further described herein is a method for manufacture of a nicotine-containing moist granulate composition, the method comprising combining nicotine or a pharmaceutically acceptable salt thereof, mannitol, and microcrystalline cellulose in a high shear mixer, and mixing while adding water. Optionally, mixing comprising mixing at least 1000 revolutions in a high shear mixer.

Further described herein is a pouch comprising a granulate, the granulate comprising: nicotine, or a pharmaceutically acceptable salt thereof, in an amount of nicotine free base equivalent between 0.1-4% by weight of the non-aqueous portion of the composition; mannitol in an amount of between 20-50% by weight of the non-aqueous portion of the composition; and total moisture of between 35-45%. Optionally, the pouch is formed from a material selected from the group consisting of: cellulose, abaca, wood pulp, rayon/viscose, cellulose-synthetic composites, polypropylene (PP) spunbond nonwovens, polyethylene/polypropylene heat-seal layers, polyethylene terephthalate (PET) spunbond, PET-core/PP-sheath bicomponent fibers, polylactic acid (PLA) nonwovens, woven nylon meshes, and purpose-built snus/nicotine pouch papers in the range of 16-35 grams per square meter.

The following examples are provided to illustrate certain particular features and/or embodiments. These examples should not be construed to limit the disclosure to the particular features or embodiments described.

EXAMPLES

Example 1: Nicotine-Containing Composition Comprising High Cellulose Content Recognizing that hypergranulation may be an issue when preparing high moisture nicotine-containing granulates, microcrystalline cellulose (MCC) was used as a main ingredient in granulates for a nicotine-containing composition for use in a pouch. MCC has a number of characteristics which would make it suitable as a main ingredient in such a granulate: 1. is non-adhesive; 2. it does not form strong liquid bridges in the absence of plasticizing binders, and 3. it could be used with much water without forming a cohesive paste.

Compositions were prepared using the following general procedure and the ingredients in Table 1.

TABLE 1

| Excipient | Function | Amount range in percent of total, by weight |
|---|---|---|
| MCC | Filler | 40-80 |
| Water | Moisture | 20-45 |
| Gum Arabic | Binder | 0.2-1 |
| Hydroxypropyl methyl cellulose | Viscosity modifier | 0-3 |
| Propylene glycol | Humectant | 2-5 |
| Sodium bicarbonate/ sodium carbonate | Buffer | As needed to adjust pH to 7.5-9.0 |
| Hydroxyapatite | Oral health enhancing agent | 1-15 (relative to solids) |
| NaCl | Tonicity adapter/flavor | 0-1 |
| Flavoring | Flavor | As needed |
| Nicotine (free base or salt) | Active | 0-4 |

A specific formulation comprising high MCC content is described in Table 2.

TABLE 2

| Excipient | Function | Amount in percent of total by weight, excluding $H_2O$ |
|---|---|---|
| Nicotine monotartrate solution | Active | 11.89 |
| Sodium bicarbonate | Buffer | 2.38 |
| Sodium carbonate | Buffer | 2.18 |
| Gum Arabic | Binder | 0.25 |
| MCC | Filler | 77.66 |
| Hydroxypropyl cellulose | Binder | 0.79 |
| Magnesium Stearate | Lubricant | 0.20 |
| Acesulfame K | Sweetener | 0.20 |
| NaCl | Tonicity adapter/flavor | 0.50 |
| E621 | Flavor enhancer | 0.99 |
| Flavors (in 80% propylene glycol solution) | Flavor | 2.97 |
| $H_2O$ | Moisture | As needed for moistening |

The pH of 7.5-9.0 is measured by dissolving 10 g of the granulate in 1 L double distilled water and stirring with a stir rod for at least 5 minuts. Nicotine monotartrate solution contains a 70:30 ratio of water to glycerol, and a concentration of nicotine monotartrate of 200 mg/ml, equivalent of nicotine free base. Granulate was formed as follows. All dry ingredients were combined and mixed in a high shear mixer. Wet ingredients were sprayed on the dry ingredients and mixing continued for at least 1000 revolutions.

Preparation of formulations with high MCC content appeared to be successful, even at high moisture levels of about 50%. Baseline wet massing with gradual water addition maintained discrete granules at modest moisture. However, sensory testing revealed a dry, chalky mouthfeel, attenuated sweetness, and slower dissolution than desirable. Enhancing mouthfeel was attempted by increasing humectant quantity but it did not fully resolve the sensory deficiency. Attempted compensation via flavor and sweetener blends raised pH management challenges while not overcoming intrinsic mouthfeel issues.

Microbial risk at higher retained moisture required addition of a preservative to obviate microbial risks. In summary, nicotine-containing compositions comprising high cellulose content were further developed due to the issues described above.

Example 2: Nicotine-Containing Composition Comprising Xylitol as Sugar Alcohol Xylitol, which is used widely in oral care, was considered as a candidate for a sugar alcohol in nicotine-containing compositions. As xylitol is known to be anti-cariogenic and provide sweetness and a cooling sensation, it was expected to be suitable for a moist nicotine pouch.

Compositions were prepared using the general procedure described in Example 1 and the ingredients in Table 3.

TABLE 3

| Excipient | Function | Amount range in percent of total, by weight |
|---|---|---|
| Xylitol | Bacteriostatic, humectant, sweetener | 35-50 |
| MCC | Filler | 25-40 |
| Water | Moisture | As needed to provide 26-35% total moisture |
| Gum Arabic | Binder | 1.0-3.5 |
| Hydroxypropyl methyl cellulose | Viscosity modifier | 1.0-3.5 |
| Propylene glycol | Humectant | 3-5 |
| Sodium bicarbonate/sodium carbonate/NaCl | Buffer/tonicity agent | As needed to adjust pH to 7.5 to 9.0 |
| Hydroxyapatite | Oral health enhancing agent | 1-15 (relative to solids) |
| Nicotine (free base or salt) | Active | 0-4 |

A specific formulation comprising xylitol is described in Table 4.

TABLE 4

| Excipient | Function | Amount in percent of total by weight, excluding $H_2O$ |
|---|---|---|
| Nicotine monotartrate solution | Active | 11.89 |
| Sodium bicarbonate | Buffer | 2.38 |
| Sodium carbonate | Buffer | 2.18 |
| Gum Arabic | Binder | 0.25 |
| MCC | Filler | 39.00 |
| Xylitol | Bacteriostatic, humectant, sweetener | 38.66 |

TABLE 4-continued

| Excipient | Function | Amount in percent of total by weight, excluding $H_2O$ |
|---|---|---|
| Hydroxypropyl cellulose | Binder | 0.79 |
| Magnesium Stearate | Lubricant | 0.20 |
| Acesulfame K | Sweetener | 0.20 |
| NaCl | Tonicity adapter/flavor | 0.50 |
| E621 | Flavor enhancer | 0.99 |
| Flavors (in 80% propylene glycol solution) | Flavor | 2.97 |
| $H_2O$ | Moisture | As needed for moistening |

During preparation of granulates having a moisture content of 26-28%, high shear mixing at 1000 revolutions led to xylitol: MCC granulates with acceptable mean particle size. After increasing mixing to more than 1000 revolutions to 2000 revolutions, catastrophic particle size growth was observed. Pasty agglomerates that fouled impellers and choppers. Similarly, when moisture content was increased from 28% to 32-35%, rapid hypergranulation occurred even at fewer than 1000 revolutions. This left only a small window between drier, powdery granulates, and pasty, non-operable granulates.

In order to mitigate the issues associated with hypergranulation and to increase flowability during the process, magnesium stearate was added in various amounts. At 1% magnesium stearate, xylitol-containing wet granulates exhibited increases in clumping in high moisture conditions. At lower levels of 0.24% magnesium stearate, no benefit was observed.

In a further attempt to mitigate the hypergranulation, sodium starch glycolate (SSG), a superdisintegrant was added with the hope that interstitial liquid would be absorbed, moderating formation of liquid bridges. Amounts of 4% to up to 8% of SSG was added to xylitol-containing granulates, but no process improvements were observed. At some concentrations, SSG swelling worsened hypergranulation by increasing internal cohesion under shear.

Another attempt to eliminate hypergranulation was performed by changing HPMC amounts. Experiments were performed at HPMC concentrations of 1-3.5% At higher HPMC concentrations of around 3%, marginally increased time to clumping but did not consistently reduce granule diameter after 1000 revolutions. In some xylitol systems, 1.0% HPMC increased granule growth. This was attributed to viscosity and bridging effects. Overall, HPMC was not reliable to mitigate formation of large granules in xylitol-based granulate.

In summary, despite multiple attempts, granulation of compositions having xylitol and MCC with greater than 10% added water tended to clump at prolonged mixing. When water was added beyond 20%, hypergranulation occurred. Nicotine compositions having total moisture of 35-45% were not obtainable using xylitol/MCC systems.

Example 3: Nicotine-Containing Granulate Composition Comprising Mannitol as Sugar Alcohol Mannitol was used as a sugar alcohol in compositions in order to obtain moist granulate having a total moisture of 35-45%.

Compositions were prepared using the general procedure described in Example 1 and the ingredients in Table 5.

TABLE 5

| Excipient | Function | Amount range in percent of total, by weight |
|---|---|---|
| Mannitol | Bacteriostatic, humectant, sweetener | 35-50 |
| MCC | Filler | 25-40 |
| Gum Arabic | Binder | 0.2-0.5 |
| Hydroxypropyl methyl cellulose | Viscosity modifier | 1.0-3.5 |
| Propylene glycol | Humectant | 3-5 |
| Sodium bicarbonate/sodium carbonate | Buffer | As needed to adjust pH to pH of 8.3-8.7 at mucosa |
| NaCl | Tonicity adapter/flavor | 0.5-2 |
| Hydroxyapatite | Oral health enhancing agent | 1-15 (relative to solids) |
| Flavoring | Flavor | As needed |
| Sweetener | Taste | As needed |
| Nicotine (free base or salt) | Active | 0-4 |

A specific formulation comprising mannitol is described in Table 6.

TABLE 6

| Excipient | Function | Amount in percent of total by weight, excluding $H_2O$ |
|---|---|---|
| Nicotine monotartrate solution | Active | 11.89 |
| Sodium bicarbonate | Buffer | 2.38 |
| Sodium carbonate | Buffer | 2.18 |
| Gum Arabic | Binder | 0.25 |
| MCC | Filler | 39.00 |
| Mannitol | Bacteriostatic, humectant, sweetener | 38.66 |
| Hydroxypropyl cellulose | Binder | 0.79 |
| Magnesium Stearate | Lubricant | 0.20 |
| Acesulfame K | Sweetener | 0.20 |
| NaCl | Tonicity adapter/flavor | 0.50 |
| E621 | Flavor enhancer | 0.99 |
| Flavors (in 80% propylene glycol solution) | Flavor | 2.97 |
| $H_2O$ | Moisture | As needed for moistening |

Water was added gradually to avoid early oversaturation and prevent clumping. At total moistures of 30-40% and controlled mixing (800-1200 revolutions) mannitol: MCC granulates remained discrete and free-flowing, with stable mean particle diameter and tight PSD, with a D90/D50 ratio is less than 2.0. Incremental moisture increases did not trigger the abrupt hypergranulation seen with xylitol. Instead, granule growth was gradual and controllable.

FIG. 1 shows a graph showing particle diameter of nicotine-containing granulate at various moisture levels prepared according to an embodiment comprising microcrystalline cellulose and mannitol (Mannitol-MCC, depicted by black triangles, described in Example 3) as compared to nicotine containing granulate comprising high quantities of microcrystalline cellulose without sugar alcohol (over 70%, MCC, depicted by grey squares, described in Example 1) and to nicotine containing granulate comprising microcrystalline cellulose and xylitol (Xylitol-MCC, depicted by grey circles, described in Example 2). In xylitol-MCC, particle size drastically increases as soon as moisture content is increased above 20%. In contrast, the mannitol-MCC formulation maintains granulate particle diameter low, consistently below 250 micrometer.

At 0.24% magnesium stearate, mannitol granules showed negligible change in diameter or flow. At 1.0% magnesium stearate, mild tendencies toward soft agglomeration appeared, but were less severe than in comparable xylitol-based systems. Gum Arabic at 0.2-0.5% maintained granule integrity without promoting adhesion.

In vivo testing and sensory panels indicated that mannitol based granulates prepared according to this example, while being stable in granulate form at high moisture levels, dissolve quickly in the oral cavity and provide strong early sweetness and flavor release. Without being bound by theory, mechanisms to explain this unexpected rapid dissolution in the oral cavity, include ionic strength and bicarbonate/carbonate effects ("salting-in" and microenvironmental wetting), matrix porosity enabling fast saliva penetration, and synergistic excipients acting as porogens or wetting agents.

As both xylitol and mannitol are considered freely soluble in pharmacopeial terms, it was expected that xylitol and mannitol would behave similarly in granulation. It was surprisingly found that mannitol: MCC systems allowed for successful wet granulation at high moistures, whereas xylitol: MCC systems did not.

Sugar alcohols such as mannitol reduce microbial risk by lowering water activity (humectants) and directly inhibiting oral pathogens, whereas a high-moisture cellulose-only pouch lacks these antimicrobial and water activity-reducing effects, making it more favorable for microbial growth under comparable moisture conditions. Mannitol containing granulate reduce the likelihood of microbial proliferation during storage and use. Therefore, at comparable moisture loads, a mannitol-containing pouch presents less microbiological risk versus a cellulose-only pouch, due to combined water activity suppression and antimicrobial action on oral biofilms.

Example 4: Nicotine-Containing Granulate Composition Comprising Mannitol as Sugar Alcohol, and Oral Health Enhancing Agent A nicotine-containing granulate composition comprising mannitol and hydroxyapatite was prepared using the following ingredients, listed in Table 7:

TABLE 7

| Ingredient | Percent by weight |
|---|---|
| $H_2O$ | 35.8 |
| Gum Arabic | 0.27 |
| HPMC | 1.05 |
| Propylene glycol | 3.20 |
| Glycerol | 3.00 |
| Cellulose | 12.50 |
| Mannitol | 29.50 |
| $NaHCO_3$ | 1.63 |
| $Na_2CO_3$ | 0.81 |
| NaCl | 1.02 |
| E621 | 1.02 |
| Hydroxyapatite | 8.20 |
| Nicotine tartrate | 1 |
| Flavors | 1 |

When hydroxyapatite was introduced into the formulation, it dispersed uniformly in the mannitol/MCC based matrix without inducing stickiness or destabilizing the granulate. Sensory assessment with the hydroxyapatite was favorable. No chalky off-notes or flavors were detected.

Additional oral health enhancing agents which may be used in addition to or in place of hydroxyapatite include the following: tricalcium phosphite, dicalcium phosphate dihydrate, octacalcium phosphate, amorphous calcium phosphate, calcium carbonate, calcium sulfate dihydrate, fluorapatite, monocalcium phosphate, functionalized tricalcium phosphate, and casein phosphopeptide-amorphous calcium phosphate.

It has been shown that compositions described herein can be formed using granulation without processing difficulty, providing palatable compositions with pleasant organoleptic properties, to effectively administer nicotine through the oral cavity, optionally in combination with at least one additional oral health enhancing agent.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

The invention claimed is:

1. A nicotine-containing moist granulate composition comprising:

nicotine, or a pharmaceutically acceptable salt thereof, in an amount of nicotine free base equivalent between 0.1-4% by weight of the non-aqueous portion of the composition;

mannitol in an amount of between 38-45% by weight of the non-aqueous portion of the composition;

microcrystalline cellulose in an amount of between 28-38% by weight of the non-aqueous portion of the composition;

and total moisture of between 35-45%, wherein the composition has a mean particle diameter of between 50 and 250 micrometer.

2. The composition according to claim 1, wherein the nicotine is present in an amount of nicotine free base equivalent between 0.6-4% by weight of the non-aqueous portion of the composition.

3. The composition according to claim 1, further comprising at least one oral health enhancing agent.

4. The composition according to claim 3, wherein the oral health enhancing agent is present in an amount of between 5-10% by weight of the non-aqueous portion of the composition.

5. The composition according to claim 3, wherein the oral health enhancing agent is selected from the group consisting of: hydroxyapatite, tricalcium phosphite, dicalcium phosphate dihydrate, octacalcium phosphate, amorphous calcium phosphate, calcium carbonate, calcium sulfate dihydrate, fluorapatite, monocalcium phosphate, functionalized tricalcium phosphate, and casein phosphopeptide-amorphous calcium phosphate.

6. The composition according to claim 1, further comprising at least one buffer.

7. The composition according to claim 6, wherein the buffer is selected from the group consisting of $NHCO_3$ and $Na_2HCO_3$.

8. The composition according to claim 1, further comprising magnesium stearate.

9. The composition according to claim 1, further comprising xanthan gum, guar gum, alibizia gum, ficus vasta gum, sesbania gum, locust bean (carob) gum, or gum Arabic.

10. The composition according to claim 1, further comprising hydroxypropylmethyl cellulose.

11. The composition according to claim 1, further comprising at least one flavoring.

12. The composition according to claim 1, having a D90/D50 ratio of less than 2.0.

13. The composition according to claim 12, wherein the nicotine is in the form of nicotine monotartrate.

14. The composition according to claim 1, and having a pH of between 7.5-9.0.

15. The composition according to claim 1, wherein the nicotine is in the form of a pharmaceutical acceptable salt selected from the group consisting of: nicotine monotartrate and nicotine citrate.

16. A method for manufacture of a nicotine-containing moist granulate composition according to claim 1, the method comprising combining nicotine or a pharmaceutically acceptable salt thereof, mannitol, and microcrystalline cellulose in a mixer, and mixing while adding water.

17. The method according to claim 16 wherein mixing comprising mixing at least 1000 revolutions in a mixer.

18. A pouch comprising a granulate according to claim 1.

19. The pouch according to claim 18, wherein the pouch is formed from a material selected from the group consisting of: cellulose, abaca, wood pulp, rayon/viscose, cellulose-synthetic composites, polypropylene (PP) spunbond nonwovens, polyethylene/polypropylene heat-seal layers, polyethylene terephthalate (PET) spunbond, PET-core/PP-sheath bicomponent fibers, polylactic acid (PLA) nonwovens, woven nylon meshes, and purpose-built snus/nicotine pouch papers in the range of 16-35 grams per square meter.

* * * * *